US010477897B2

(12) United States Patent
Schlipf

(10) Patent No.: US 10,477,897 B2
(45) Date of Patent: Nov. 19, 2019

(54) AIR AND/OR AEROSOL HEATER

(71) Applicant: Türk & Hillinger GmbH, Tuttlingen (DE)

(72) Inventor: Andreas Schlipf, Tuttlingen (DE)

(73) Assignee: Türk & Hillinger GmbH, Tuttlingen (DE)

( * ) Notice: Subject to any disclaimer, the term of this patent is extended or adjusted under 35 U.S.C. 154(b) by 105 days.

(21) Appl. No.: 15/437,636

(22) Filed: Feb. 21, 2017

(65) Prior Publication Data

US 2017/0238609 A1 Aug. 24, 2017

(30) Foreign Application Priority Data

Feb. 22, 2016 (DE) ..... 20 2016 100 917 U

(51) Int. Cl.

| | |
|---|---|
| ***A24F 47/00*** | (2006.01) |
| ***H05B 3/04*** | (2006.01) |
| ***H05B 3/06*** | (2006.01) |
| ***H05B 3/46*** | (2006.01) |

(52) U.S. Cl.

CPC ..... *A24F 47/008* (2013.01); *H05B 3/04* (2013.01); *H05B 3/06* (2013.01); *H05B 3/46* (2013.01); *H05B 2203/014* (2013.01); *H05B 2203/021* (2013.01); *H05B 2203/022* (2013.01)

(58) Field of Classification Search

None

See application file for complete search history.

(56) References Cited

U.S. PATENT DOCUMENTS

| | | | | | |
|---|---|---|---|---|---|
| 1,404,645 | A | * | 1/1922 | Powers | F02M 31/13 219/207 |
| 1,759,969 | A | * | 5/1930 | Turnwald | F02N 19/10 219/208 |
| 2,146,402 | A | * | 2/1939 | Morgan | H05B 3/78 219/523 |
| 2,274,839 | A | * | 3/1942 | Marick | F16L 53/38 219/522 |
| 2,375,563 | A | * | 5/1945 | Kirk | C07C 67/30 202/185.5 |
| 3,063,286 | A | * | 11/1962 | Nerheim | G01N 30/16 206/0.6 |

(Continued)

FOREIGN PATENT DOCUMENTS

| | | |
|---|---|---|
| DE | 697 22 928 T2 | 5/2004 |
| DE | 100 42 396 B4 | 6/2005 |

(Continued)

*Primary Examiner* — Thor S Campbell

(74) *Attorney, Agent, or Firm* — McGlew and Tuttle, P.C.

(57) ABSTRACT

An air and/or aerosol heater (10, 20, 30, 40, 50, 60, 70, 80, 90, 100, 110, 120, 130, 140, 150), especially for an e-cigarette, includes a tube (11, 21, 31, 34, 35, 41, 51, 61, 71, 81, 91, 101, 111, 121, 131, 141, 151), in which air and/or aerosol can be heated, and includes a resistor element (12, 22, 32, 42, 52, 62, 72, 82, 92, 102, 112, 122, 132, 142, 152) arranged on the outer surface of the tube (11, 21, 31, 34, 35, 41, 51, 61, 71, 81, 91, 101, 111, 121, 131, 141, 151) or on the inner surface of the tube (11, 21, 31, 34, 35, 41, 51, 61, 71, 81, 91, 101, 111, 121, 131, 141, 151). The resistor element (12, 22, 32, 42, 52, 62, 72, 82, 92, 102, 112, 132, 142, 152) is fixed on the tube (11, 21, 31, 34, 35, 41, 51, 61, 71, 81, 91, 101, 111, 121, 131, 141, 151).

20 Claims, 19 Drawing Sheets

(56) References Cited

U.S. PATENT DOCUMENTS 3,120,600 A * 2/1964 True ..... F24H 1/142 392/468
3,247,359 A * 4/1966 Feld ..... F24H 1/121 392/480
3,275,803 A * 9/1966 True ..... F16L 53/38 219/535
3,355,572 A * 11/1967 Chrow ..... F16L 53/38 392/468
3,373,724 A * 3/1968 Papst ..... F02B 23/00 123/145 A
3,378,673 A * 4/1968 Hopper ..... F16L 53/38 392/472
4,192,988 A * 3/1980 Pederson, Jr. ..... A61L 2/04 134/19
4,776,353 A * 10/1988 Lilja ..... A24B 15/18 131/273
4,847,469 A * 7/1989 Hofmann ..... C23C 16/4485 392/397
5,134,684 A * 7/1992 Mishou ..... F24H 3/0405 392/379
5,271,086 A * 12/1993 Kamiyama ..... F24H 1/142 137/341
5,388,594 A * 2/1995 Counts ..... A24F 47/008 128/202.21
5,930,459 A * 7/1999 Eckman ..... H05B 3/04 392/503
6,167,196 A * 12/2000 Huggins, Jr. ..... H05B 3/44 392/373
6,456,785 B1 * 9/2002 Evans ..... F24H 1/102 392/448
6,611,660 B1 * 8/2003 Sagal ..... F28F 1/124 219/546
7,004,234 B2 * 2/2006 Povall ..... C23C 14/243 165/58
7,190,892 B2 * 3/2007 Kertesz ..... F16L 53/008 392/465
7,203,419 B2 * 4/2007 Malone ..... F16L 53/38 392/468
8,330,958 B2 * 12/2012 Levitsky ..... G01N 21/05 356/442
9,745,679 B2 * 8/2017 Zhang ..... D04B 21/14
9,835,355 B2 * 12/2017 Evans ..... F24H 1/142
9,955,731 B2 * 5/2018 Liu ..... H05B 3/44
2010/0206415 A1 * 8/2010 Ellis ..... F16L 53/37 138/33
2014/0130796 A1 5/2014 Liu
2015/0007835 A1 1/2015 Liu
2015/0181943 A1 * 7/2015 Li ..... H05B 3/48 131/329

FOREIGN PATENT DOCUMENTS

DE 10 2004 061 883 A1 7/2006
DE 20 2013 105 420 U1 4/2014
DE 20 2015 006 397 U1 1/2016

* cited by examiner

A-A

AIR AND/OR AEROSOL HEATER

CROSS REFERENCE TO RELATED APPLICATIONS

This application claims the benefit of priority under 35 U.S.C. § 119 of German Application 20 2016 100 917.0, filed Feb. 22, 2016, the entire contents of which are incorporated herein by reference.

FIELD OF THE INVENTION

The present invention relates to an air and/or aerosol heater, especially for an e-cigarette, with a tube in which air and/or aerosol can be heated, and with a resistor element.

BACKGROUND OF THE INVENTION

The enrichment of air with active ingredients and/or aromas, as is desired, for example, in inhalers or e-cigarettes, in many cases requires that the air and/or the active ingredient be heated rapidly. It is known, for example, from DE 100 42 396 B4 for stationary use or from DE 20 2013 105 420 U1 for mobile use in e-cigarettes, that electrical heating devices are used for such a purpose.

SUMMARY OF THE INVENTION

An object of the present invention is to provide an improved air and/or aerosol heater, which takes into account to a great extent especially the requirements of use in a mobile device, for example, in connection with mobile inhalers and especially with e-cigarettes, which in many cases prevent the application of prior-art concepts because of their weight, their size or their power consumption and make it absolutely necessary to develop new devices especially for such applications.

According to the invention, an air and/or aerosol heater for an e-cigarette is provided. The heater comprises a tube in which air and/or aerosol can be heated and a resistor element arranged on an outer surface of the tube or on an inner surface of the tube, wherein the resistor element is fixed on the tube. The fixing of the resistor element on the tube is with a fixing device.

The air and/or aerosol heater according to the present invention, which is especially well suited for use in an e-cigarette, has a tube, in which air and/or aerosol can be heated, and a resistor element arranged on the outer surface of the tube or on the inner surface of the tube. The resistor element is preferably configured as a resistance wire, but it is also possible for a printed heating track or a heating track applied according to the thick-layer or thin-layer method to be used as a resistor element. The resistor element preferably extends on or at the corresponding surface in a coiled form, for example, as a single or double coil. Especially when using resistance wires, this is advantageously wound or coiled on the outer surface of the tube.

It should be noted that the tube, which is advantageously used in an air and/or aerosol heater for a mobile inhaler, would colloquially rather be called a small tube, because it is small, thin-walled, lightweight and relatively fragile. The word tube should correspondingly be interpreted more narrowly in this sense than is common in colloquial usage.

It is essential for the present invention in this connection that the resistor element be fixed on the tube. This measure brings with it a number of significant advantages, to better understand which it is helpful to once again recall first some of the requirements that follow from an applicability to a mobile inhaler, especially an e-cigarette. First, these devices should be small and compact in order to permit good portability and comfortable handling. This then leads to the fact that the aerosol heater used in it shall now also possess these properties. Second, these devices are handled in situations of everyday life and are correspondingly also subject to mechanical stresses.

The resistor element correspondingly typically also has a relatively thin and flexible configuration in order to make it possible to obtain the narrow bending radii necessary for the small and compact configuration, especially without having to apply excessively strong forces on the tube or small tube, which could damage or even destroy this. However, this means that a deformation, a displacement or slipping of the resistor element may readily occur when forces act. Such forces readily occur in situations of everyday life, in which the mobile inhalers are handled, for example, in case of shocks, e.g., when a user accidentally lets the mobile inhaler fall out of his hand. In addition, there also are forces that occur during the heating of the resistor element.

As a consequence of the deformation, displacement or slipping of the resistor element, the latter may not possibly be locally in contact with the tube in a gap-free manner any longer, and/or deviations may develop from the desired local distribution of the heat output over the pipe. All these undesired effects can be effectively counteracted by the fixation according to the present invention of the resistor element.

In addition, at least some types of fixation of the resistor element, especially fixation on one side at the end of the tube, may entail advantages in terms of the manufacturing technology, and other types of fixation of the resistor element may contribute to an improvement of the electrical insulation of the resistor to the outside and/or of individual windings of the resistor element from one another.

Concretely, there are a plurality of possibilities and fixing devices to bring about such a fixation, some of which will be described in detail below.

For example, the resistor element may be fixed mechanically at the end or at the ends, but it may also be fixed, after having been placed on the tube, by an at least local application of a fixing layer, e.g., a ceramic putty or a glass melt, or by means of a yarn.

In addition to the requirements imposed on the size of the air and/or aerosol heater, which arise from the desire to have a small type of construction for use in a mobile inhaler and especially in an e-cigarette, the energy supply available for the heating, usually a battery or a storage battery, is limited, so that it is important to only operate the air and/or aerosol heater in case of an acute need for the shortest possible time period. It is thus decisive to make the heating process as fast as possible, to which a low thermal mass makes a decisive contribution. It will advantageously be possible for an air and/or aerosol heater in which the resistor element is fixed to use a tube with a wall thickness of $d \leq 0.6$ mm. Especially preferred are embodiments in which the wall thickness is $d \leq 0.4$ mm.

The length of the tube of the air and/or aerosol heater also contributes to the thermal mass of the heater. It is advantageous for an air and/or aerosol heater in which the resistor element is fixed that the tube has a length of $1 \leq 12$ mm, and it is possible to create embodiments in which the length is $1 \leq 8$ mm.

Making the tube of a material with a thermal conductivity of $\lambda \geq 2$ W/(m×K)—which is also expressed as $\lambda \geq 2$ W/mK—proved to be an advantageous condition for ensuring that the desired operating conditions will be reached rapidly each time after the heater has been switched on. Especially suitable in this connection is the use of ceramic tubes, especially of ceramic tubes made of alumina or steatite ceramic. The mechanical properties of these ceramic tubes are especially well suited for use in an air and/or aerosol heater according to the present invention if the ceramic tubes are densely sintered.

It was surprisingly found that it was possible to manufacture the air and/or aerosol heaters that worked best in the test operation with the steatite material C221, which makes it possible to manufacture very delicate and thin-walled ceramic tubes, even though they have a lower thermal conductivity than alumina. In addition, the use of C221 leads to advantages in price compared to alumina.

Especially fixing elements arranged on the tube in the form of recesses, especially if they pass through the entire tube wall, or grooves as well as projections arranged on the tube proved to be suitable fixing devices, with which the resistor element is fixed on the tube. As an alternative or in addition, the resistor element may be fixed on the tube by covering in at least some sections with a fixing layer, which covering may also be prepared by casting in at least some sections.

Suitable materials for such a covering or casting are, for example, putties, curable adhesives or glass and can be a part of a fixing device. It should be stressed in this connection that fixation by covering or casting in some sections is possible not only insofar as the tube is not covered with the corresponding material over its entire length, but can also be achieved by the tube not being covered with the corresponding material all around its entire circumference. In particular, the resistor element may advantageously be fixed on the tube by a strip-shaped cover, which preferably extends along the direction in which the tube extends.

It further proved to be advantageous if the effective cross section of the resistor element is greater in the area of the tube ends than in the middle of the tube, so that the heat output is lower there. This can be achieved especially easily if the effective cross section of the resistor element is increased at the tube ends by windings of the resistor element, which are short-circuited with one another, which can be achieved especially by crimping, welding, soldering or twisting.

Due to the resistor element being embodied as an insulating oxidized resistance wire, which embodiment can be considered to be especially advantageous, it becomes possible to wind the wire turn to turn on the tube in at least some sections. This makes possible an even more compact type of construction, which leads to an even smaller thermal mass.

It further proved to be advantageous if a terminal section is present, in which the electrical connection with electrical supply lines is established, the terminal section being thermally uncoupled from at least one section of the tube. Such a thermal uncoupling may be achieved, for example, by the terminal section being formed by the fixing device.

In case of a fixing device that is separate from the tube, this can be achieved by a projection of the fixing device projecting over the tube body.

In case of a fixing device integrated in the tube, this can be achieved with a projection, which projects over the tube body and which may be formed integrally in one piece with the tube, but it may also be embodied, for example, as an alternative hereto, by a section of the tube wall, which section is separated from the rest of the tube wall by two slot-like (slot/slot shaped) recesses, which preferably extend in the direction in which the tube extends.

The present invention will be explained in more detail below on the basis of figures, which show exemplary embodiments. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1A:
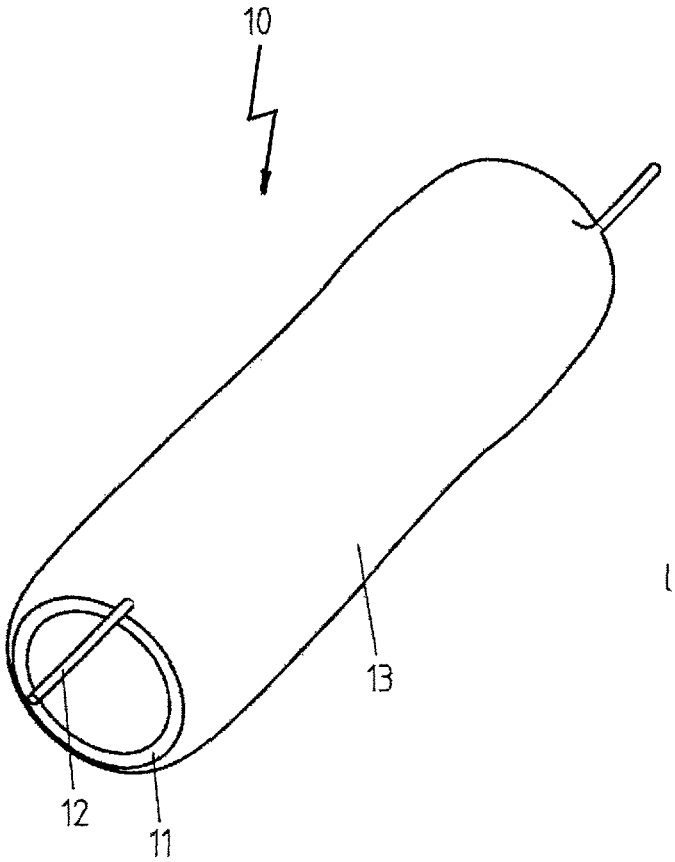
FIG. 1*a* is a perspective view of a first embodiment of an air and/or aerosol heater.

Referring to the drawings the reference symbols d and l are used in all figures for the wall thickness and the length of the respective tube, respectively, in which air and/or aerosol can be heated. It shall, moreover, be pointed out that all figures show greatly enlarged views of air and/or aerosol heaters according to the present invention.

Figure 1B:
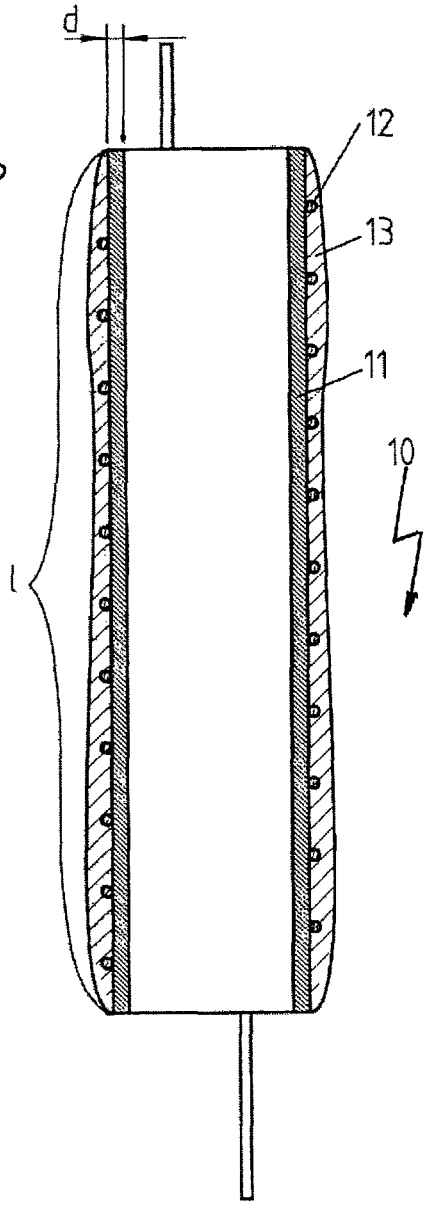
FIG. 1*b* is a cross sectional view through the air and/or aerosol heater from FIG. 1*a;*

The air and/or aerosol heater 10 shown in FIGS. 1*a* and 1*b* has a tube 11 with a thickness d and with a length l, in which air and/or aerosol can be heated, and a resistor element 12, which is wound on the outer surface of the tube 11 and which is configured as a resistance wire. The resistor element 12 is fixed on the tube 11 with a fixing layer 13, which may be configured, e.g., as a ceramic putty or as a glass melt, which fully surrounds the tube 11 in this exemplary embodiment.

Figure 2A:
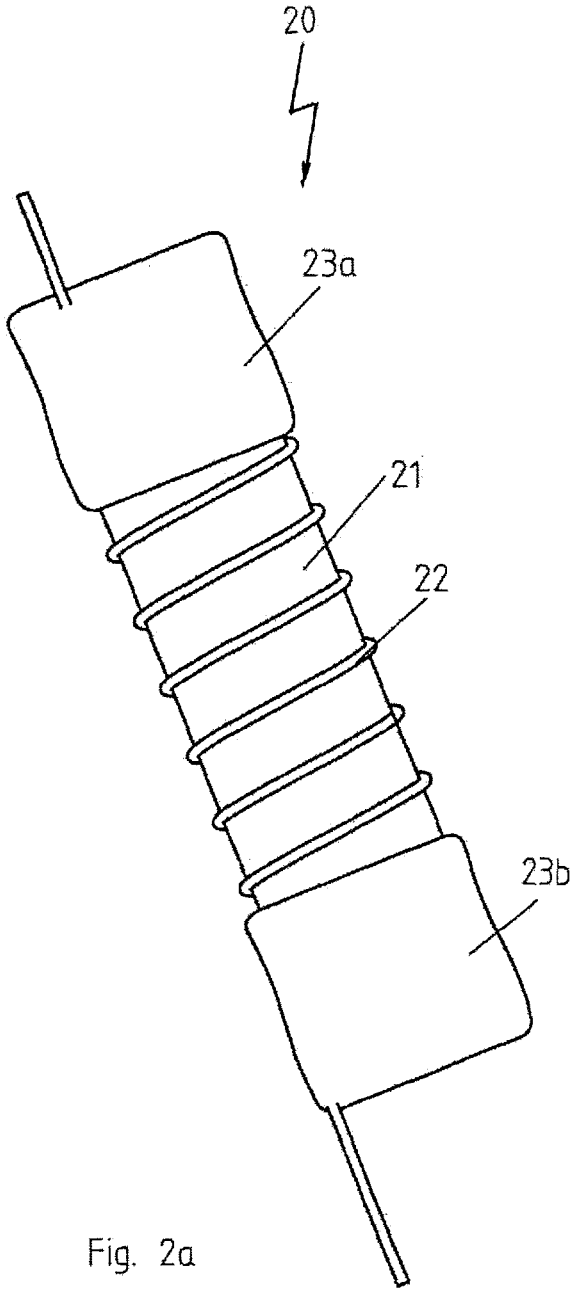
FIG. 2*a* is a side view of a second embodiment of an air and/or aerosol heater.
Figure 2B:
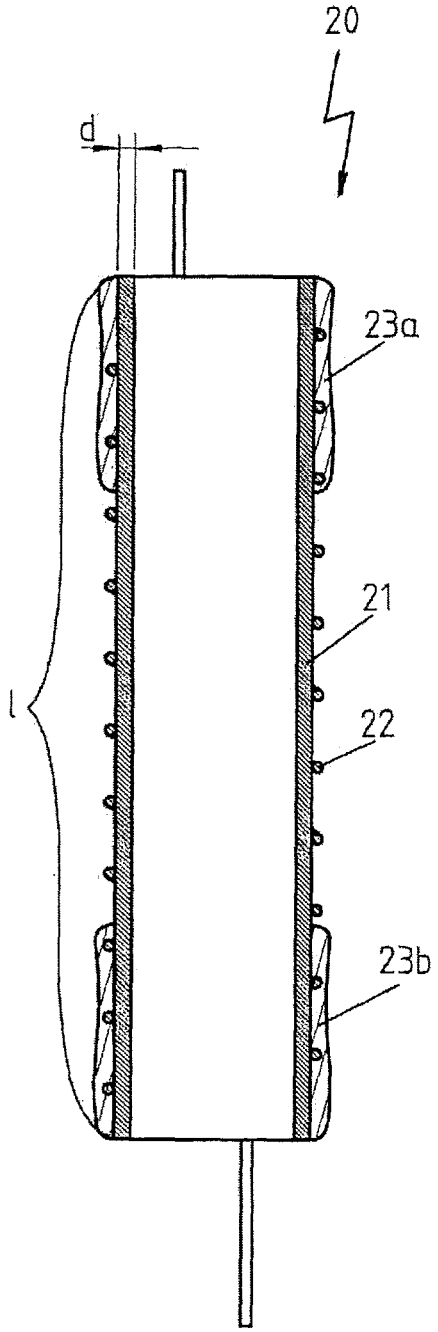
FIG. 2*b* is a cross sectional view through the air and/or aerosol heater from FIG. 2*a;*

The embodiment of an air and/or aerosol heater 20 with tube 21 and with resistor element 22, which embodiment is shown in FIGS. 2*a* and 2*b*, differs from the embodiment according to FIGS. 1*a* and 1*b* in that fixing layers 23*a* and 23*b* are arranged here in the areas of both ends of the tube 21, while no additional fixation is present in the area between the fixing layers 23*a* and 23*b*. Consequently, there is a fixation of the end areas only, which also prevents a slipping of the entire resistor element 22.

Figure 14A:
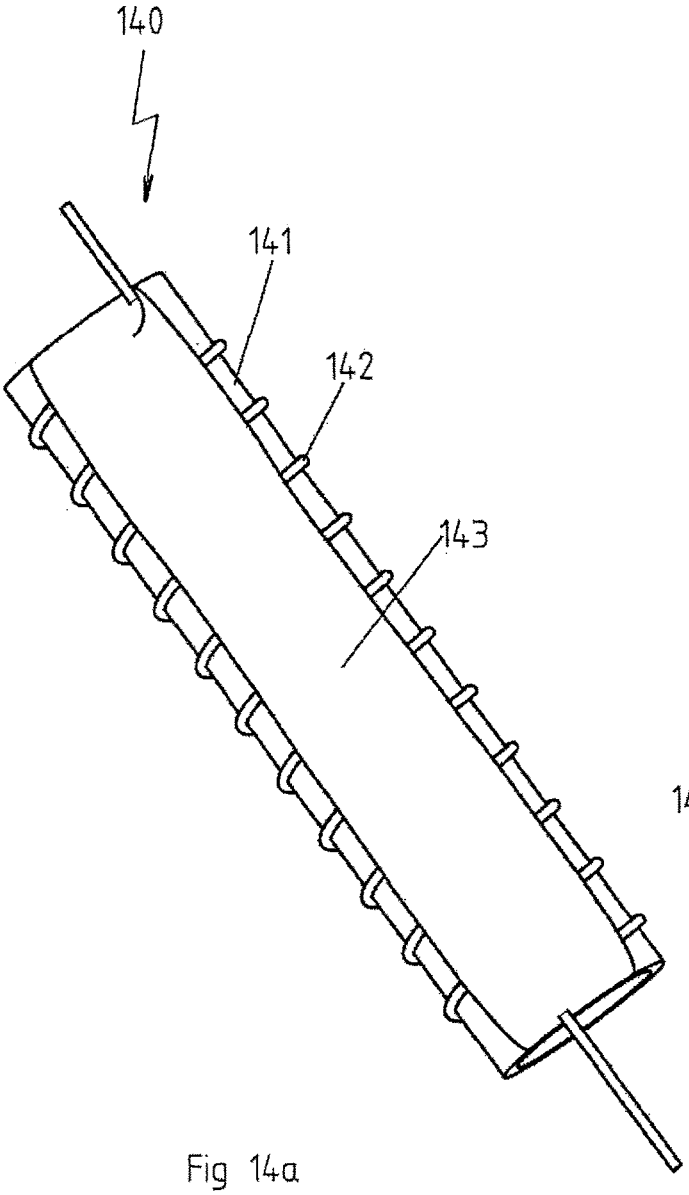
FIG. 14*a* is a side view of an eleventh embodiment of an air and/or aerosol heater.
Figure 14B:
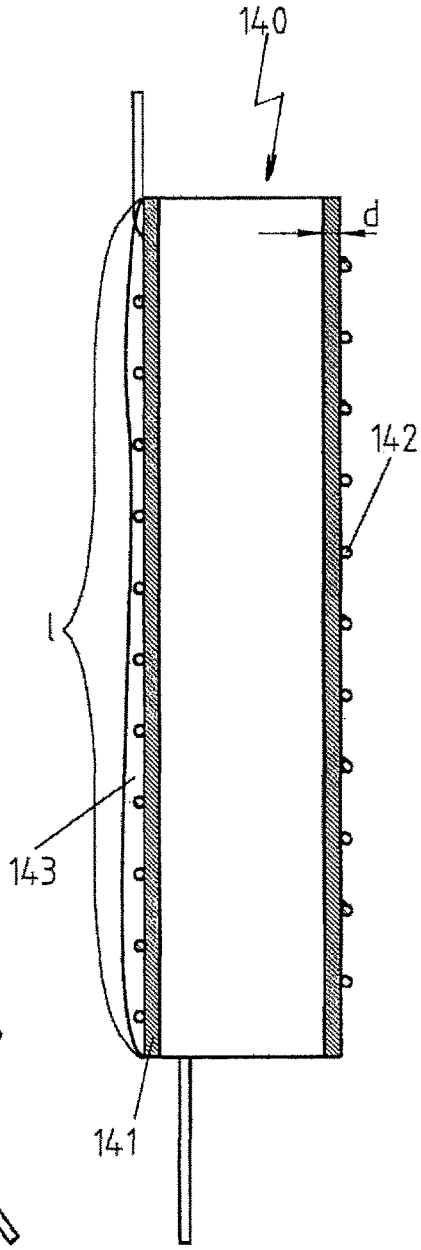
FIG. 14*b* is a cross sectional view through the air and/or aerosol heater from FIG. 14*a*.

Another embodiment with a fixing layer is shown in FIGS. 14*a* and 14*b*. The embodiment of an air and/or aerosol heater 140 with tube 141 and resistor element 142, which is shown there, differs from the embodiment according to FIGS. 1*a* and 1*b* in that a strip-shaped fixing layer 143 is arranged here in a partial area of the circumference of the tube only, while no additional fixation is present in the remaining circumferential area of the tube.

The application of a fixing layer, as it is shown as an example in the exemplary embodiments discussed up to now, is also suitable, in principle, if needed, for an additional fixation when fixing devices having a different configuration, which are explained as examples in the exemplary embodiments discussed below.

Figure 3A:
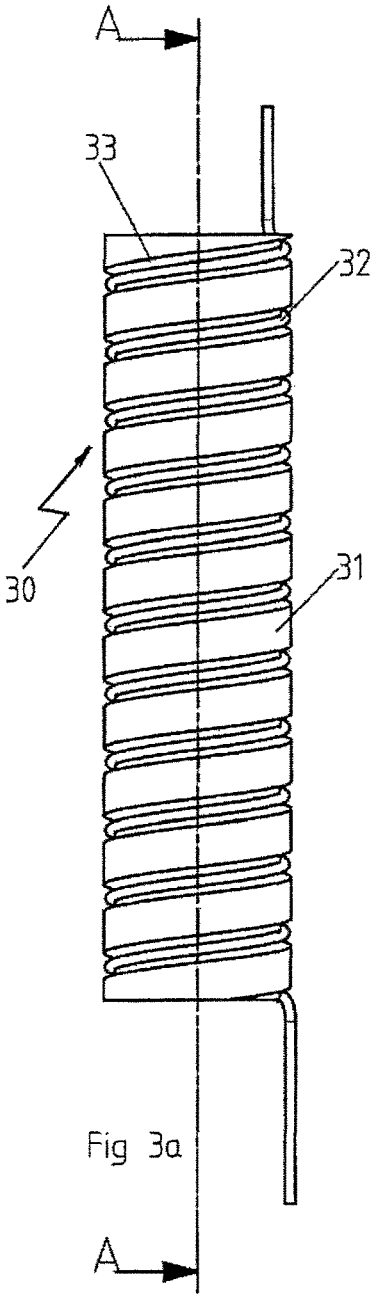
FIG. 3*a* is a side view of a third embodiment of an air and/or aerosol heater.
Figure 3B:
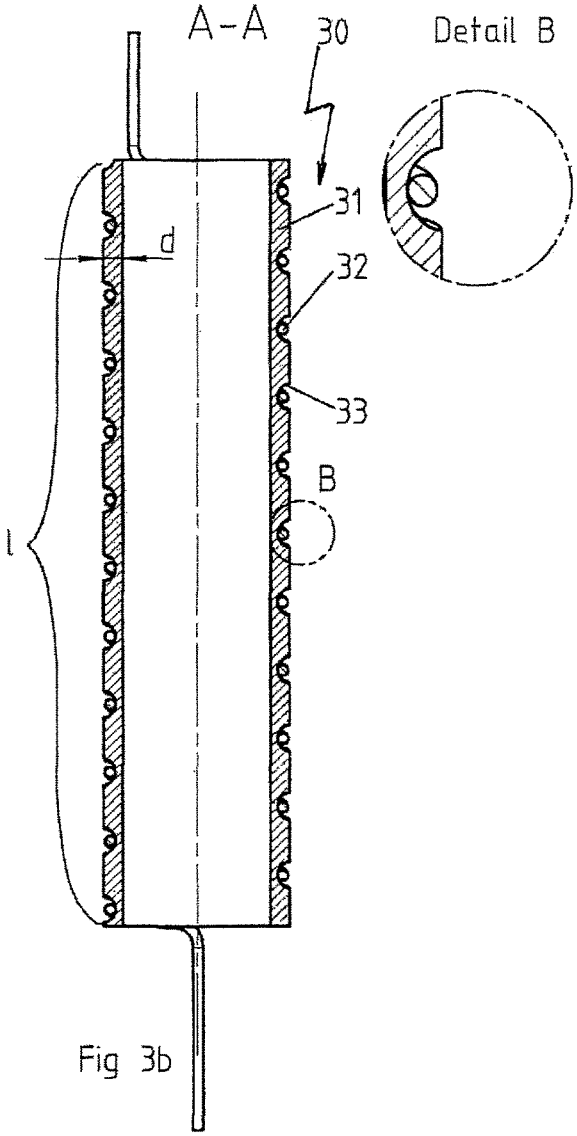
FIG. 3*b* is a cross sectional view through the air and/or aerosol heater from FIG. 3*a;*
Figure 3C:
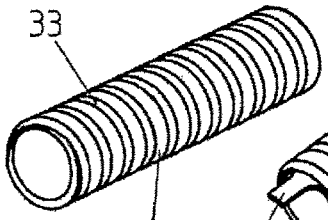
FIG. 3*c* is a perspective view of the tube of the air and/or aerosol heater from FIG. 3*a;*

In the embodiment of an air and/or aerosol heater 30 with a tube 31 and with a resistor element 32, which embodiment is shown in FIGS. 3*a* through 3*c*, a groove 33 milled helically in the tube 31 is used to fix the resistor element 32 configured as a resistance wire. A fixing layer, e.g., one as shown in FIG. 1*a* or FIG. 2*a*, may, of course, optionally be applied here as well. It is advantageous for this purpose if the width of the groove 33 is greater than the thickness of the resistor element 32. It may now be advantageous, in particular, to provide a groove with, e.g., a semicircular or semielliptical cross section, which can easily be prepared, especially if one is prepared according to a ceramic injection molding technology.

Figure 3D:
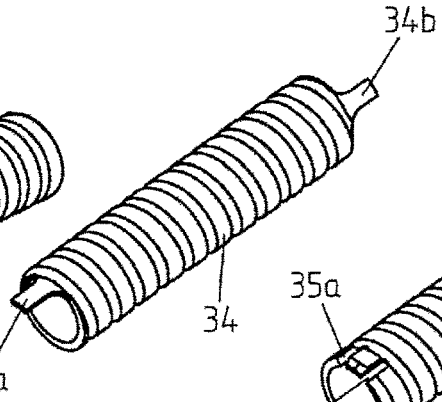
FIG. 3*d* is a perspective view of a first alternative for the tube from FIG. 3*c;*
Figure 3E:
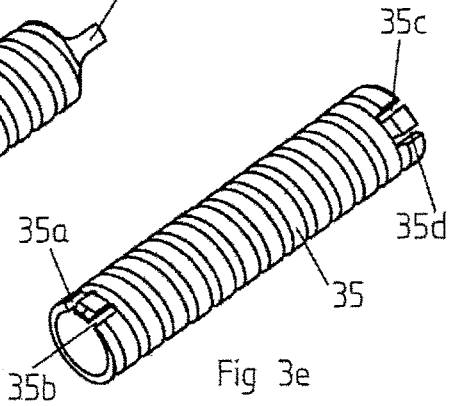
FIG. 3*e* is a perspective view of a second alternative for the tube from FIG. 3*c;*

Instead of the tube shown as an individual tube in FIG. 3*c*, it is also possible, for example, to use the tube 34 shown in FIG. 3*d* with additional front-side projections 34*a,b* or the tube 35 shown in FIG. 3*e* with two additional, front-side slot-like (slot/slot shaped) recesses 35*a,b* and 35*c,d* passing through the tube wall. The projections 34*a,b* and recesses 35*a-d* support the fixation of the resistor element 32 and may advantageously be used during the initial fixation of the resistor element 32 on one of the front sides as a starting point for the winding process during the winding of the resistor element 32 into the groove 33, which brings advantages with it in terms of manufacturing technology. In addition, as will be explained in more detail below based on other exemplary embodiments, they can make possible a simple and reliable contacting with electrical terminals. Moreover, they lead to a thermal uncoupling of the terminal area for terminal wires, which terminal area is advantageously arranged at the respective projection 34*a,b* and in the respective section between the recesses 35*a*, 35*b*.

Figure 15:
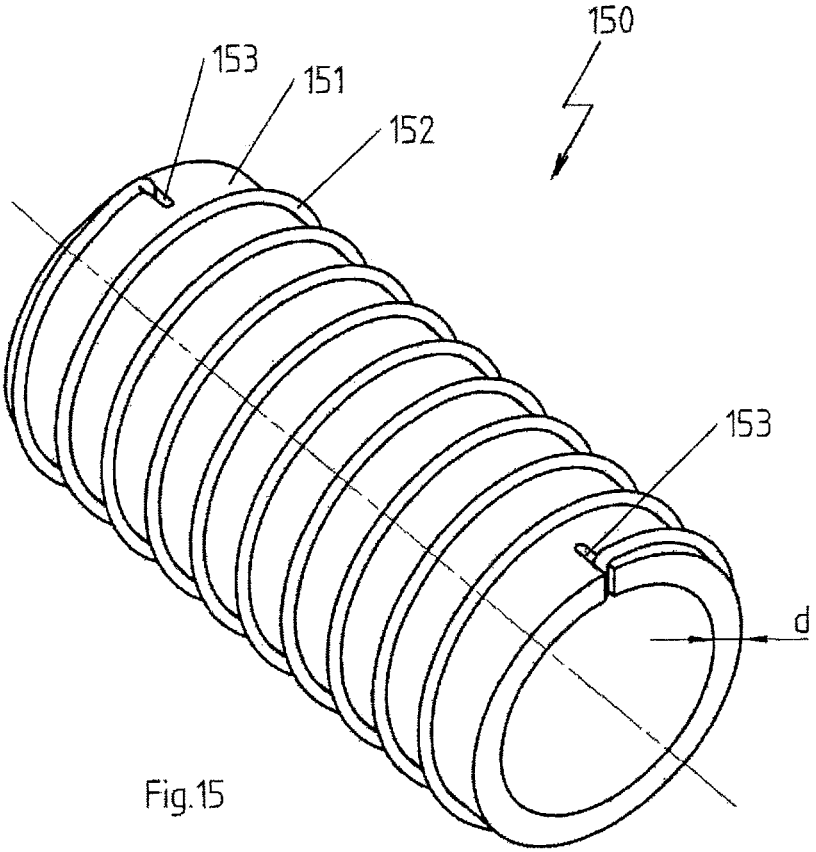
FIG. 15 is a perspective view of a twelfth embodiment of an air and/or aerosol heater.

Yet another variant for configuring the tube is shown in the exemplary embodiment of an air and/or aerosol heater 150 with tube 151 and resistor element 152, which exemplary embodiment is shown in FIG. 15. A recess each, passing through the tube wall in the form of a slot 153, which slot preferably has a somewhat smaller width than the diameter of the resistor element 152 when viewed in the circumferential direction of the tube, is present here as a fixing device in the front-side end areas of the tube 151. The resistor element 152 is fixed here by clamping the end sections of the resistor element 152 in the slots 153. A fixed starting point, which facilitates an efficient and cost-effective manufacture, can also be created in this way for the winding process in a very simple manner.

Figure 4A:
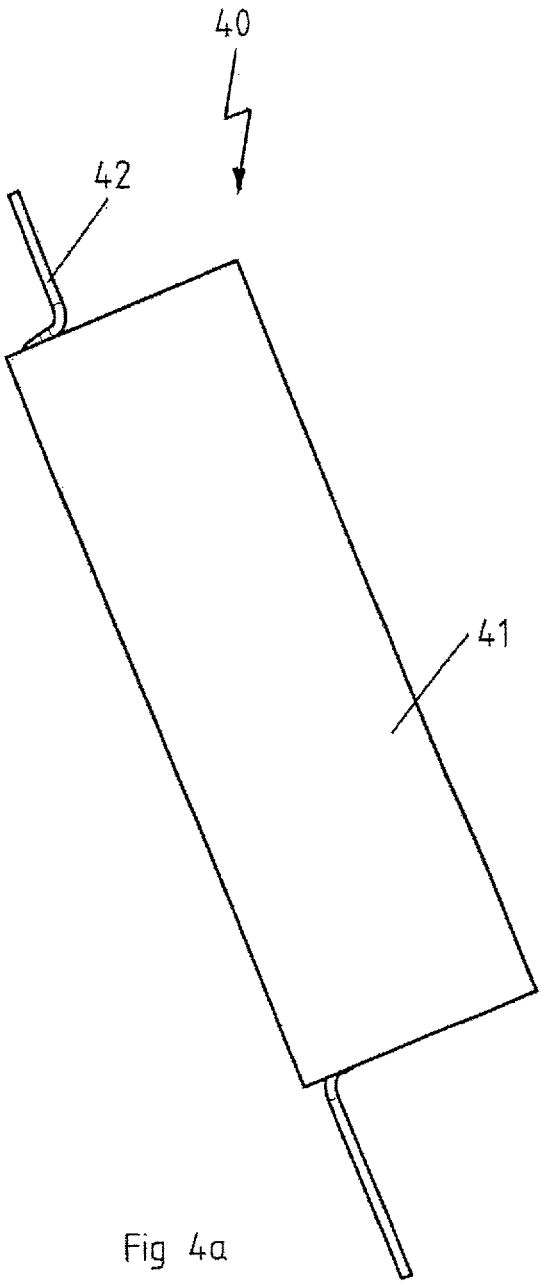
FIG. 4*a* is a side view of a fourth embodiment of an air and/or aerosol heater.
Figure 4B:
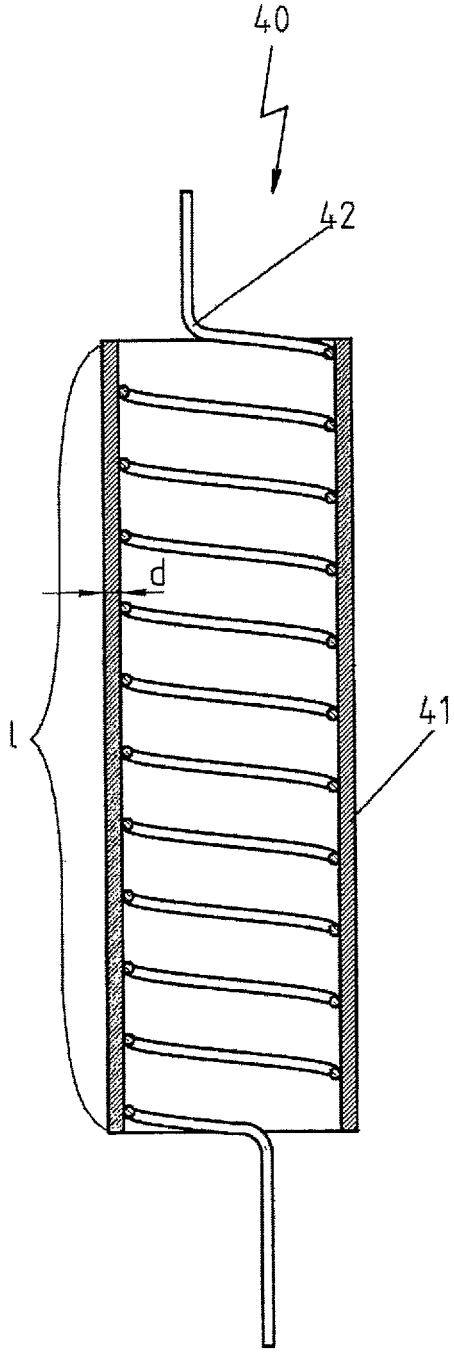
FIG. 4*b* is a cross sectional view through the air and/or aerosol heater from FIG. 4*a;*

The air and/or aerosol heater 40 shown in FIGS. 4*a* and 4*b* has a tube 41 with a wall thickness d and a length l, in which air and/or aerosol can be heated, and a resistor element 42 wound on the inner surface of the tube 41, which resistor element is configured as a resistance wire. Not shown for the sake of clarity is the fixing device, which may also be configured, e.g., as in the exemplary embodiments according to FIGS. 1 and 2 as a ceramic putty or as a glass layer, which is then arranged on the inner side of the tube or can be prepared, as in FIG. 3, by inserting the resistor element 42 into a groove provided in the inner wall of the tube.

Figure 5:
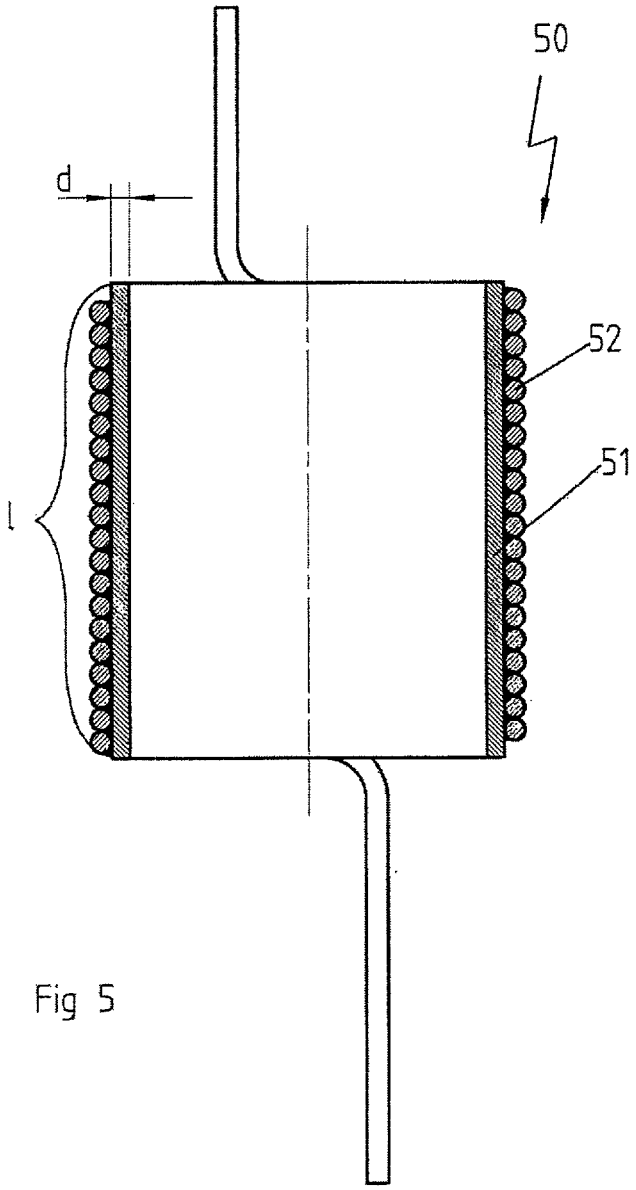
FIG. 5 is a cross sectional view through a fifth embodiment of an air and/or aerosol heater.

The air and/or aerosol heater 50 shown in FIG. 5 has a tube 51 with a wall thickness d and the length l, in which air and/or aerosol can be heated, and an insulating, oxidized resistance wire 52 wound on the surface of the tube 51 as a resistor element. Because of this property of the resistor element, a dense winding can be performed, in which adjacent coils touch each other, which will then make possible an especially short embodiment having a small mass. The fixing device is likewise not shown here for the sake of clarity; it may also be configured, just as in the exemplary embodiments according to FIGS. 1 and 2, e.g., as a ceramic putty or as a glass layer, which is then arranged on the inner side of the tube, or it may be configured, as in FIGS. 3*d* and 3*e*, by end-side fixation at projections or recesses.

Figure 6A:
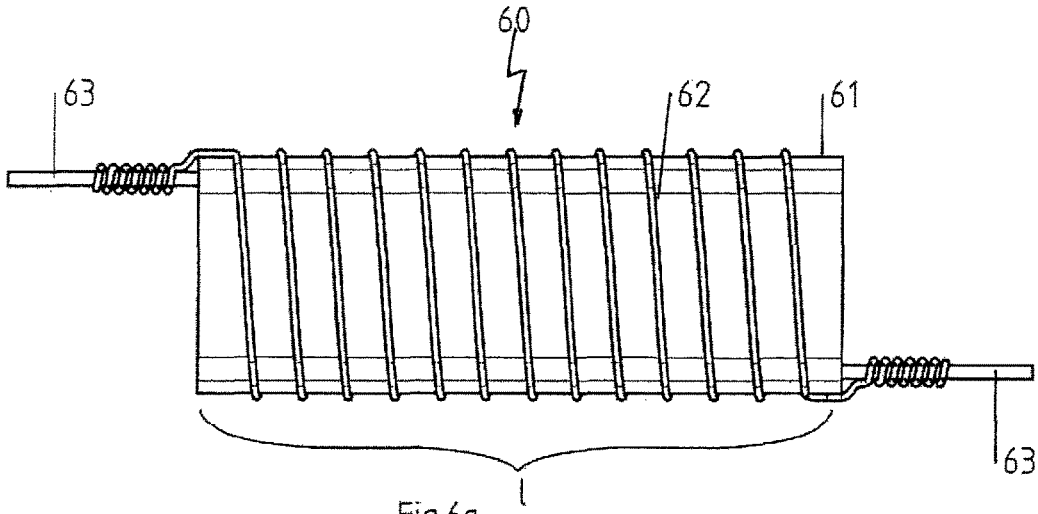
FIG. 6*a* is a first side view of a sixth embodiment of an air and/or aerosol heater.
Figure 6B:
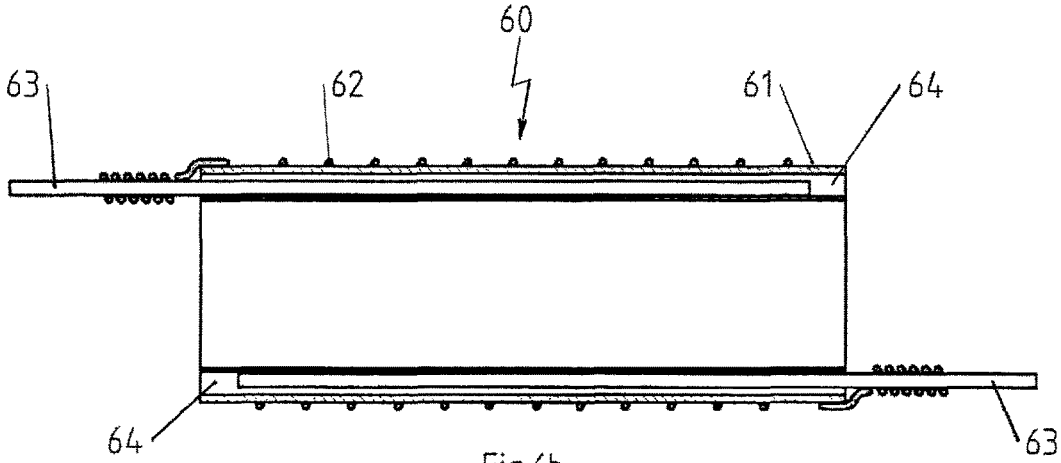
FIG. 6*b* is a cross sectional view through the air and/or aerosol heater from FIG. 6*a;*
Figure 6C:
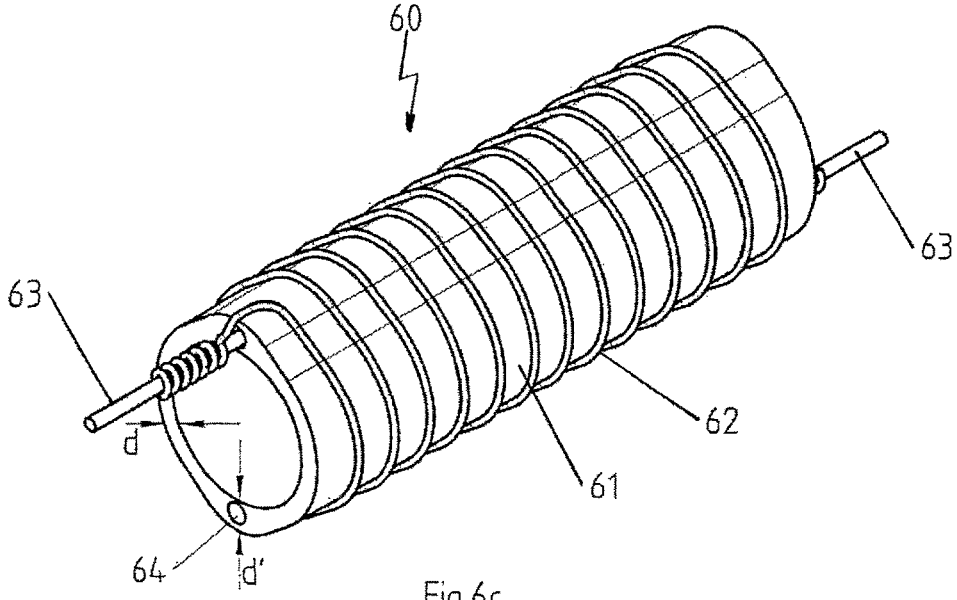
FIG. 6*c* is a second view of the air and/or aerosol heater from FIG. 6*a;*

The air and/or aerosol heater 60 shown in FIGS. 6*a-c* has a tube 61 with a wall thickness d and a length l, in which air and/or aerosol can be heated, and a resistor element 62, which is wound on the outer surface of the tube 61 and which is configured as a resistance wire. Auxiliary wires 63, which are arranged in holes 64 in the tube wall of the tube 61, which tube wall can be locally reinforced for this at these locations to a wall thickness d', are used for fixing the resistor element 62 on the tube 61. The mode of operation of this fixation possibility is similar to the end-side fixation described in connection with FIGS. 3*d* and 3*e* and offers essentially the same advantages. The auxiliary wires 63 may additionally also be used for power supply.

Figure 6D:
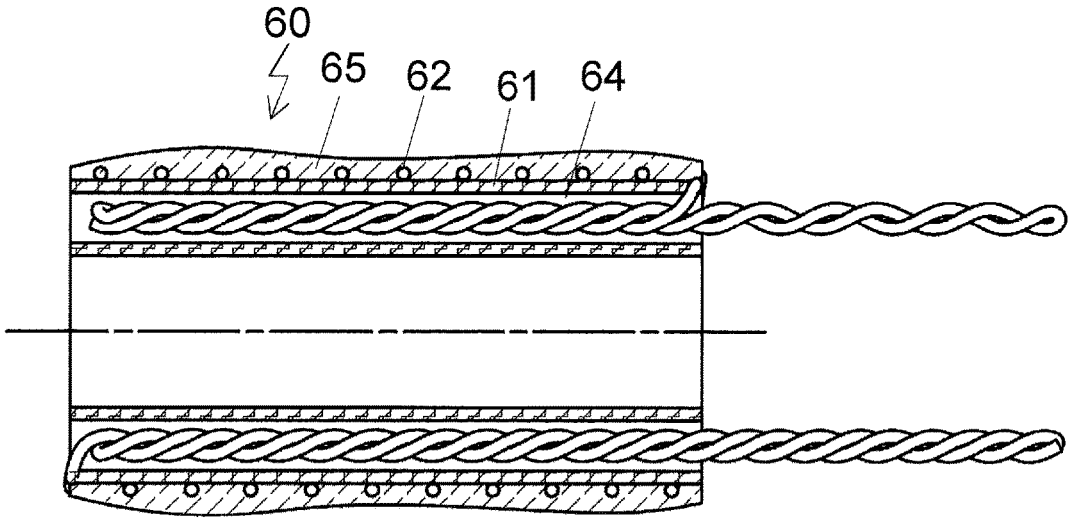
FIG. 6*d* is a sectional view of a first variant of the air and/or aerosol heater from FIG. 6*a;*
Figure 6E:
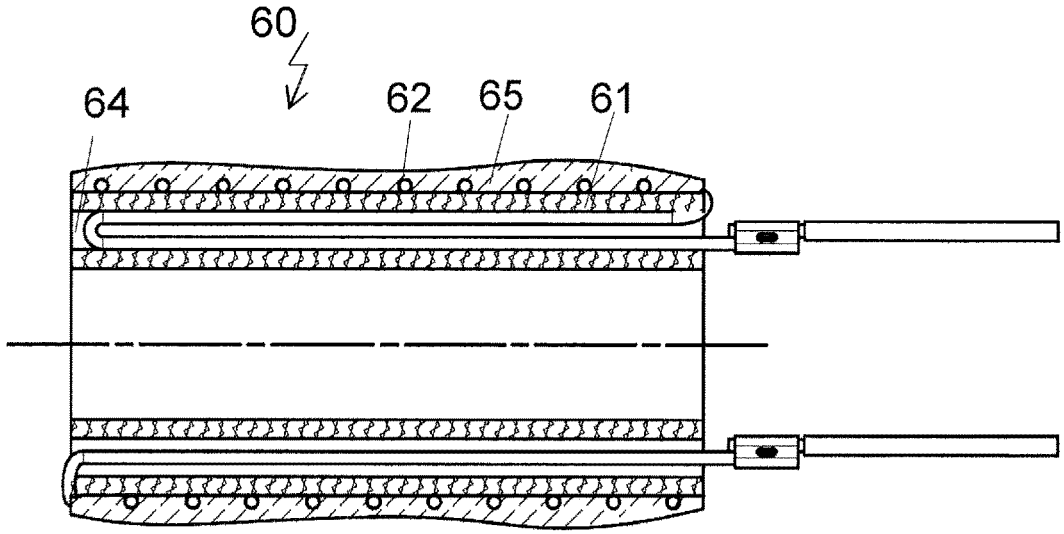
FIG. 6*e* is a sectional view of a second variant of the air and/or aerosol heater from FIG. 6*a;*

FIGS. 6*d* and 6*e* show variants of the air and/or aerosol heater from FIGS. 6*a-c*. Instead of the auxiliary wires 63, sections of the resistor element 62 are each guided through the holes 64 here, wherein one section of the resistor element 62 each is guided there and back again in one of the holes—as an example, the upper hole shown here.

In the exemplary embodiment of FIG. 6*d*, this occurs by the resistor element 62 being twisted into the sections guided into the holes 64, wherein it is wound separately in the area, in which it runs on the tube 61 before it, twisted again, and runs back through the other hole.

In the exemplary embodiment of FIG. 6*e*, which is simpler in terms of manufacturing technology, the resistor element 62 is guided through one of the holes 64, bent by 180° at the end of the hole and again guided back to the first end of the tube 61. The section wound on the tube 61 is connected thereto, which section is again dipped into a hole 64 and is guided through this hole.

In both cases, the guiding of the resistor through the hole makes a considerable contribution to the fixing of the resistor element 62 and to improving the defined positioning thereof on the tube 61. In addition, a fixing layer 65 may also be provided in the exemplary embodiments of FIGS. 6*d* and 6*e* for further improvement of the fixing. Such a fixing layer 65 may be configured, e.g., as a ceramic putty or as a glass layer and which encloses the tube 61 entirely or even only in some sections or is applied, e.g., in the form of a strip.

Figure 7A:
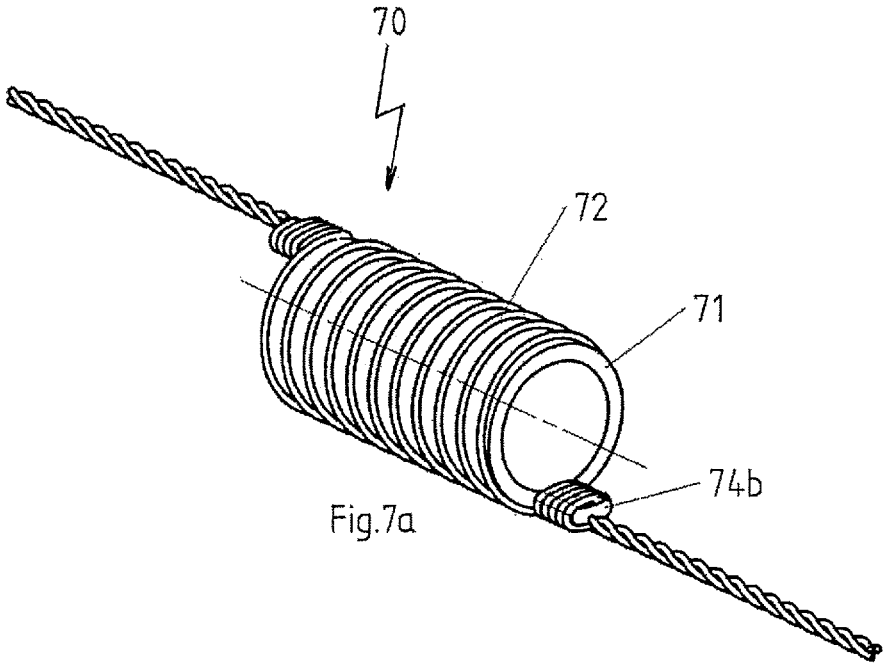
FIG. 7*a* is a perspective view of a seventh embodiment of an air and/or aerosol heater.
Figure 7B:
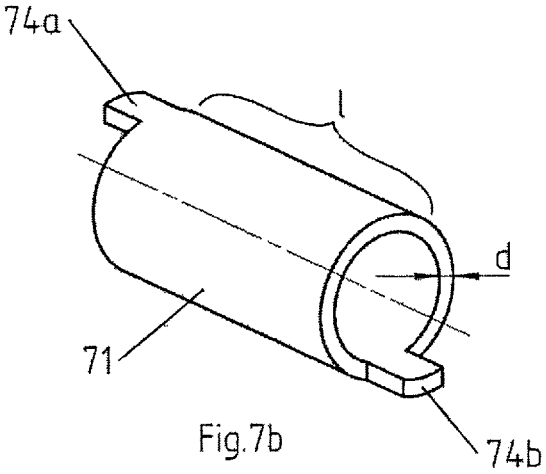
FIG. 7*b* is a perspective view the tube of the air and/or aerosol heater from FIG. 7*a;*

Different possibilities of establishing the necessary electrical connection shall now be discussed based on the embodiment of an air and/or aerosol heater 70 with tube 71 and resistor element 72, which embodiment is shown in FIGS. 7*a* and 7*b* and in which the tube 71 shown separately in FIG. 7*b* has front-side projections 74*a,b* as fixing devices similarly to the tube shown separately in FIG. 3*d*. FIG. 7*b* shows for this a first variant, in which the sections of the resistor element 72 arranged on the projections 74*a,b* are wound tightly, so that there is an electrical connection between the coils of these sections in case of a resistor element whose surface is not insulated, the resistor element 72 being inserted in a twisted configuration in order to reduce the effective electrical resistance in the feed line sections. The resistance wire may be drilled either with itself but also with an auxiliary wire having a better electrical conductivity, e.g., a copper or pure nickel auxiliary wire.

Figure 7C:
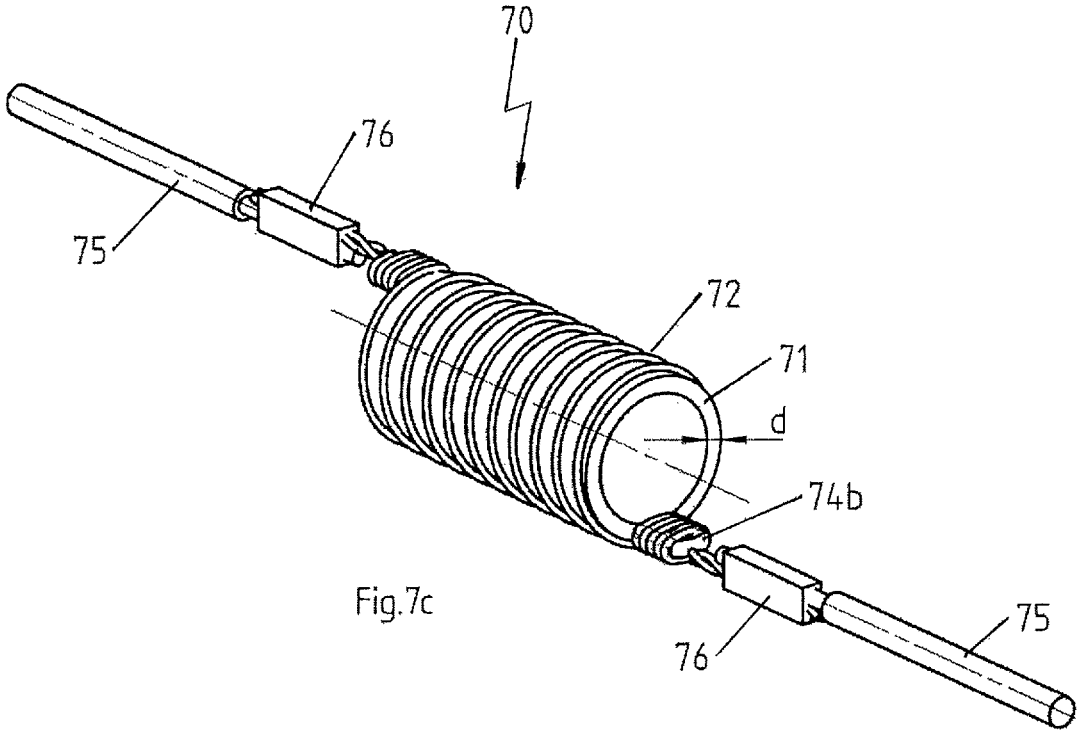
FIG. 7*c* is a perspective view of a first alternative connection possibility for the air and/or aerosol heater from FIG. 7*a;*
Figure 7D:
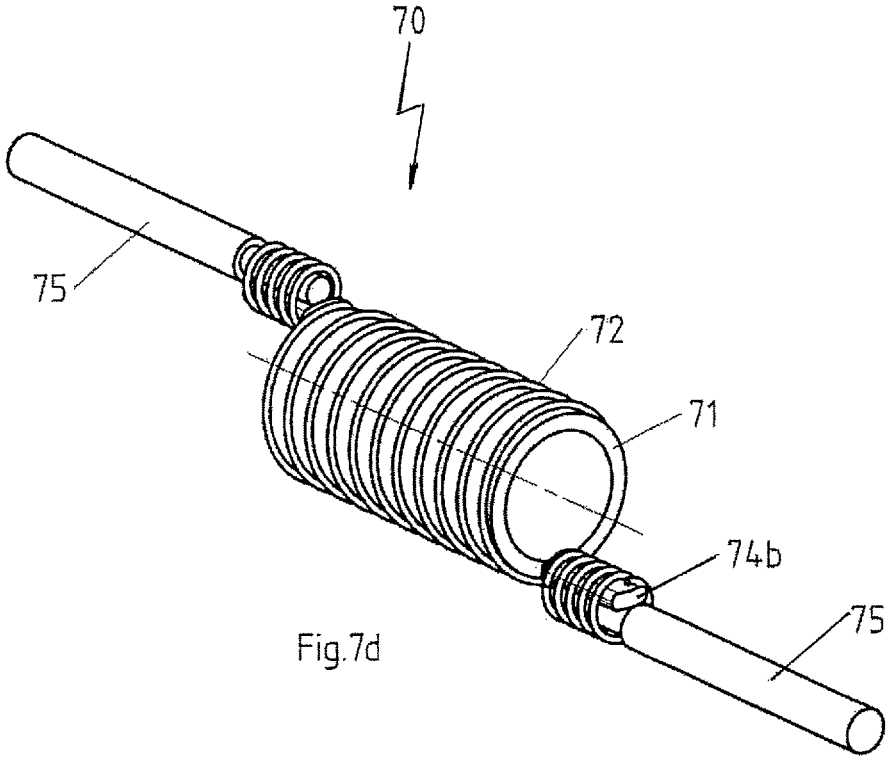
FIG. 7*d* is a perspective view a second alternative connection possibility for the air and/or aerosol heater from FIG. 7*a;*

As an alternative to this, it is possible, as is shown in FIG. 7*c*, to establish the contact with a terminal wire 75 by crimping with a crimping element 76 or, as is shown in FIG. 7*d*, to wind the end section of the resistor element 72 firmly around the terminal wire 75, so that the terminal wire is pressed onto the respective projection 74*a,b*.

Figure 7E:
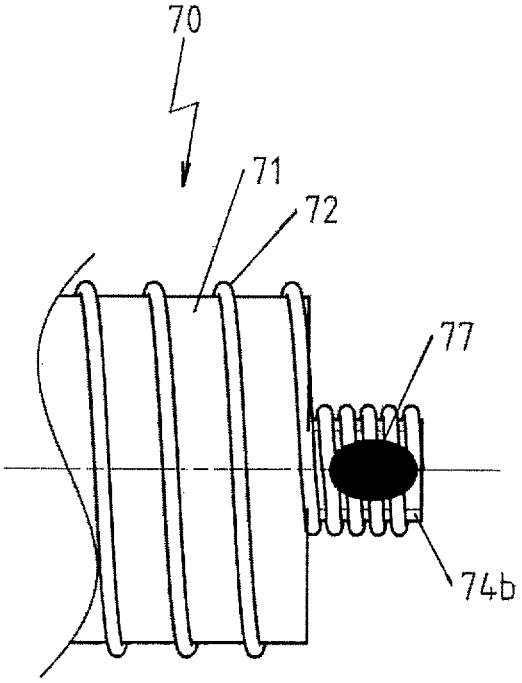
FIG. 7*e* is a partially cut away side view of a variant of the air and/or aerosol heater from FIG. 7*a* turns of the resistor element in the end area of the tube, which turns are short-circuited with one another.
Figure 7F:
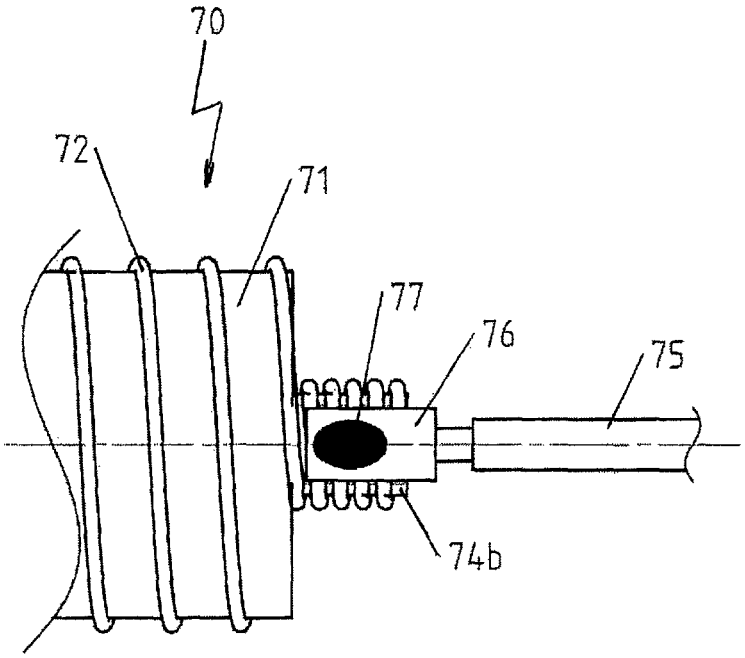
FIG. 7*f* is a partially cut away side view of a third alternative connection possibility for the air and/or aerosol heater from FIG. 7*a;*
Figure 7G:
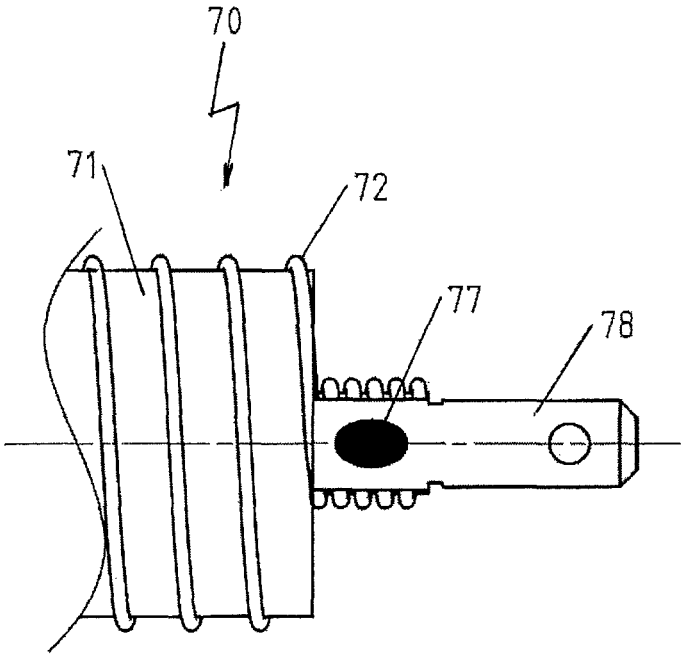
FIG. 7*g* is a perspective view of a fourth alternative connection possibility for the air and/or aerosol heater from FIG. 7*a;*

As shown especially in FIG. 7*e*, the effective cross section of the resistor element 72 can be increased at the tube ends by turns of the resistor element short-circuited with one another by a resistance weld connection 77 or a soldering point. This resistance weld connection 77 or this soldering point may then at the same time be connected with a crimping element 76, shown in FIG. 7*f*, to the terminal wire 75 or with a flat plug 78 shown in FIG. 7*g* (in a much less enlarged view contrary to the other components shown) to form a welded terminal.

Figure 8A:
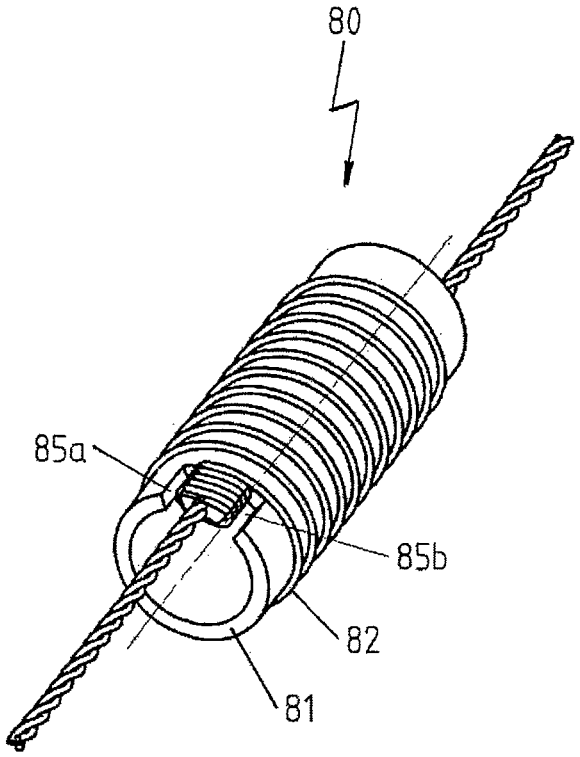
FIG. 8*a* is a perspective view of an eighth embodiment of an air and/or aerosol heater.
Figure 8B:
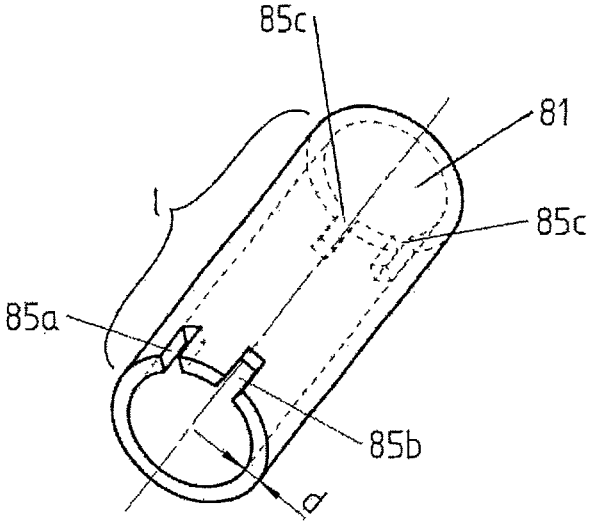
FIG. 8*b* is a perspective view of the tube of the air and/or aerosol heater from FIG. 7*a;*

These connection possibilities can, of course, be applied directly, especially also to the embodiments of an air and/or aerosol heater 80 with tube 81 and resistor element 82, which embodiment is shown in FIGS. 8*a* and 8*b* and in which the tube 81 shown separately in FIG. 8*b* is additionally provided with two front-side recesses 85*a,b* and 85*c,d* each, respectively, similarly to the tube shown separately in FIG. 8*b*.

Figure 9:
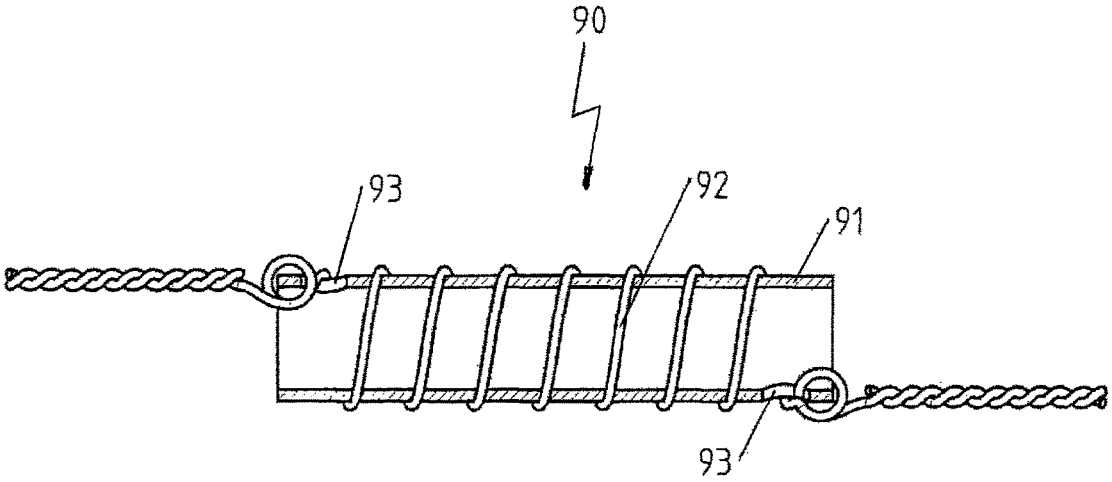
FIG. 9 is a cross sectional view through a ninth embodiment of an air and/or aerosol heater.

The exemplary embodiment of an air and/or aerosol heater 90 with tube 91 and resistor element 92, which embodiment is shown in FIG. 9, shows yet another possibility of achieving fixation of the resistor element 92. Holes 93 are provided in this exemplary embodiment as fixing devices in the end sections of the tube 91 in the tube jacket thereof, and the resistance element 92, which is inserted optionally in a twisted form here as well, is threaded at least once and preferably several times through said holes in order to achieve fixation on the tube 91.

Figure 10A:
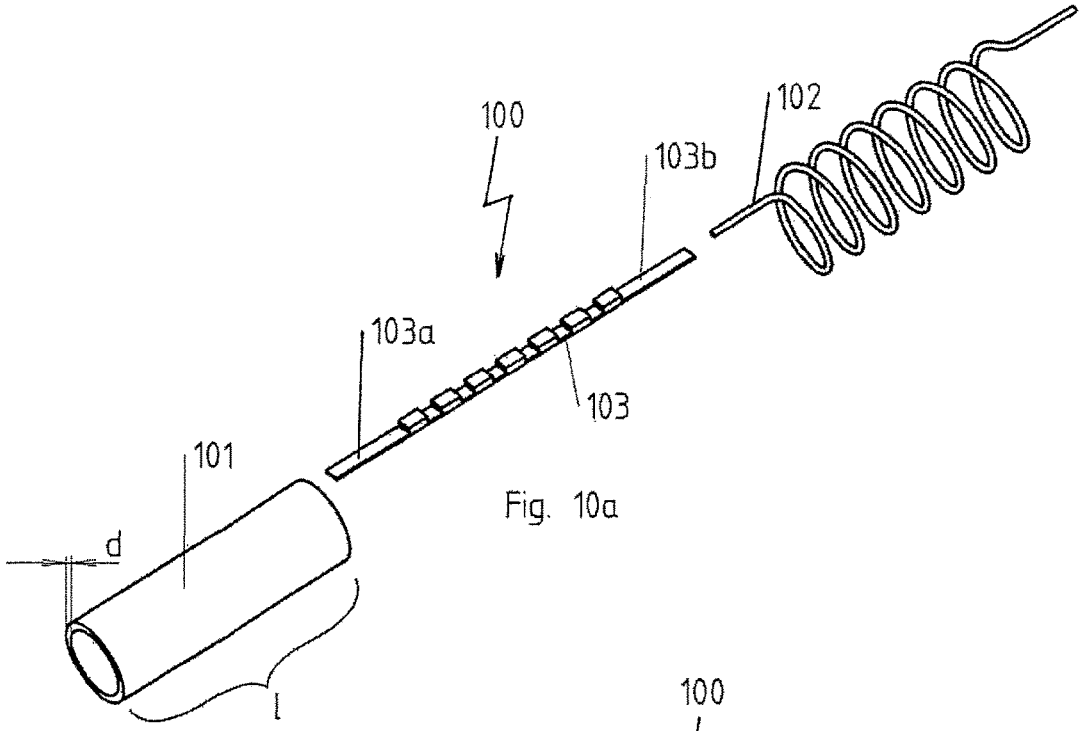
FIG. 10*a* is an exploded view of a tenth embodiment of an air and/or aerosol heater.
Figure 10B:
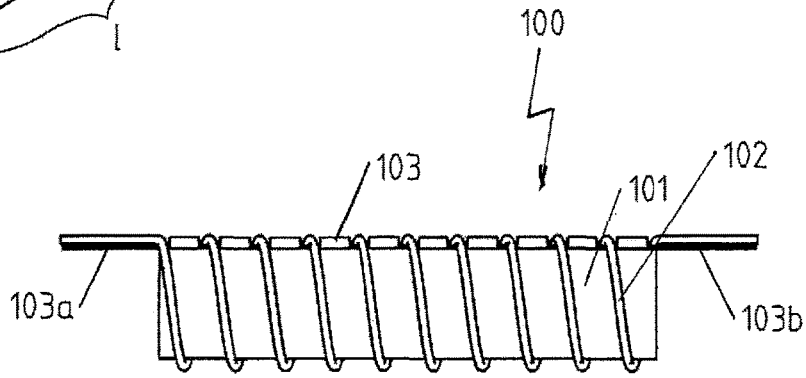
FIG. 10*b* is a side view of the air and/or aerosol heater from FIG. 10*a;*

Another principle of fixing individual coils of the heating element on the air and/or aerosol heater will now be described with reference to FIGS. 10*a* through *c* as well as 11 through 13. The air and/or aerosol heater 100 shown in FIGS. 10*a* through 10*c* has, in addition to the tube 101 and the resistor element 102 arranged thereon, a fixing element 103 having a comb-like (comb/comb shaped) configuration, which is manufactured as a separate component, for example, according to a ceramic injection molding method, into which the resistor element 102 is coiled. The fixing element 103 may be fixed on the tube 101 by the resistor element 102, but it may also be fastened in another manner, e.g., bonded or sintered.

Figure 10C:
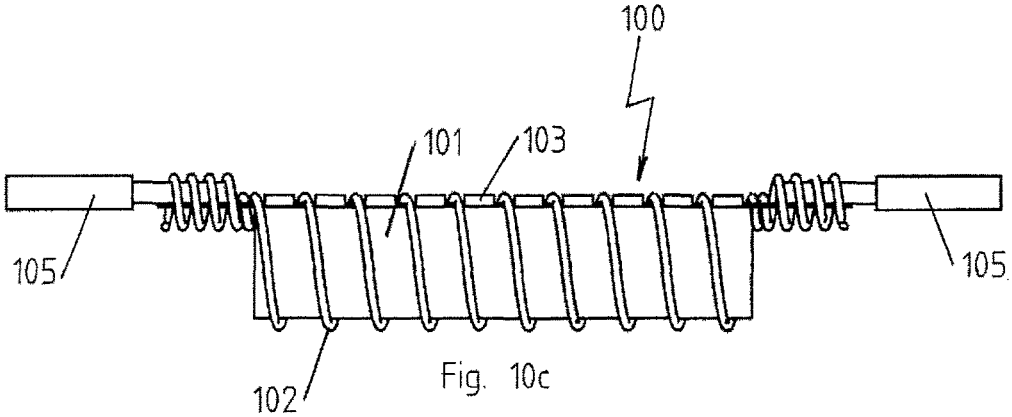
FIG. 10*c* is a side view of the air and/or aerosol heater from FIG. 10*a* in the connected state.

Sections 103*a*, 103*b* of the fixing element 103 project over the tube 101 on the front side in this exemplary embodiment, as a result of which it becomes possible, as is shown in FIG. 10*c*, to establish the electrical connection to terminal wires 105 in a manner similar to that described above in connection with FIG. 7*d*. It is, however, also possible, of course, to embody other types of electrical connection, especially the other alternatives described for this embodiment in the context of FIGS. 7*a* through 7*e*.

Figures 11, 12, 13:
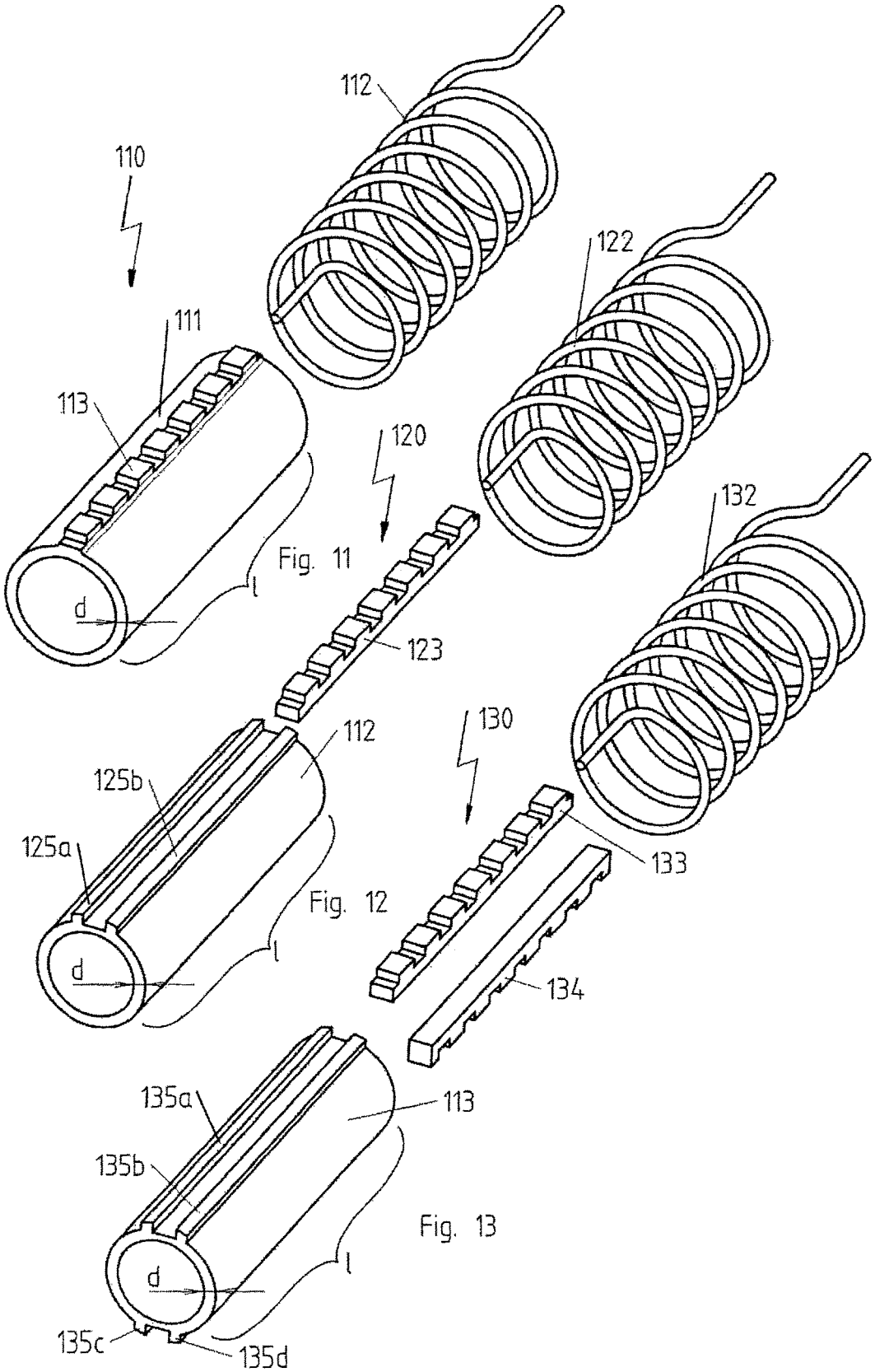
FIG. 11 is an exploded view of a first variant of the air and/or aerosol heater shown in FIG. 10*a;*
FIG. 12 is an exploded view of a second variant of the air and/or aerosol heater shown in FIG. 10*a;*
FIG. 13 is an exploded view of a third variant of the air and/or aerosol heater shown in FIG. 10*a;*

The air and/or aerosol heaters 110, 120, 130 with tube 111, 121, 131 and with resistor element 112, 122, 132 as well as with comb-like fixing elements 113, 123, 133 and 134, which are shown in FIGS. 11, 12 and 13, show variants of this principle. The comb-like fixing element 113 is made in one piece with the tube 111 in the air and/or aerosol heater 110.

In the air and/or aerosol heater 120, the comb-like (comb/comb shaped) fixing element 123 is fitted with a precise fit on the tube 122 between two webs 125*a*, 125*b*, which stabilize it against displacement in the circumferential direction, which is a risk especially in the course of the winding process.

Two comb-like (comb shaped) fixing elements 133, 134, which are fitted with a precise fit between two respective webs 135*a*, 135*b* and 135*c*, 135*d* arranged on the tube, are provided opposite each other in the air and/or aerosol heater 130, said webs stabilizing the fixing element against displacement in the circumferential direction. It is, of course, also possible to use even larger numbers of fixing elements.

While specific embodiments of the invention have been shown and described in detail to illustrate the application of the principles of the invention, it will be understood that the invention may be embodied otherwise without departing from such principles.

What is claimed is:

1. An air and/or aerosol heater for an e-cigarette, the heater comprising:

a tube in which air and/or aerosol can be heated; and a resistor element arranged on an outer surface of the tube or on an inner surface of the tube, wherein the resistor element is fixed on the tube, the resistor element being fixed on the tube with a covering in at least some sections, with a fixing layer or with a casting, in at least some sections, with a fixing layer, at least a portion of the fixing layer defining at least a portion of an outermost layer of the heater, wherein an effective cross section of the resistor element is greater at tube ends than in a middle of the tube.

2. An air and/or aerosol heater in accordance with claim 1, wherein the tube has a wall thickness that is less than or equal to 0.6 mm.

3. An air and/or aerosol heater in accordance with claim 1, wherein the tube has a length that is less than or equal to 12 mm.

4. An air and/or aerosol heater in accordance with claim 1, wherein the tube is comprised of a material with a thermal conductivity that is greater than or equal to 2 W/mK.

5. An air and/or aerosol heater in accordance with claim 1, wherein the tube is a ceramic tube.

6. An air and/or aerosol heater in accordance with claim 5, wherein the ceramic tube is manufactured from an alumina or steatite ceramic.

7. An air and/or aerosol heater in accordance with claim 5, wherein the ceramic tube is densely sintered.

8. An air and/or aerosol heater in accordance with claim 1, wherein:

the resistor element is fixed on the tube with at least one recess or groove arranged on the tube and/or with the use of at least one projection arranged on the tube.

9. An air and/or aerosol heater in accordance with claim 1, wherein the resistor element is fixed on the tube by a comb fixing element.

10. An air and/or aerosol heater in accordance with claim 1, wherein an effective cross section of the resistor element is increased at the tube ends by turns of the resistor element, which are short-circuited with one another.

11. An air and/or aerosol heater in accordance with claim 1, wherein the resistor element comprises an insulating oxidized resistance wire, which is wound turn to turn.

12. An air and/or aerosol heater in accordance with claim 1, further comprising a terminal section, in which an electrical connection is established to electrical supply lines, wherein the terminal section is thermally uncoupled from at least one section of the tube.

13. An air and/or aerosol heater in accordance with claim 1, wherein:

the tube comprises a tube wall with at least one hole in the tube wall; and the resistor element is fixed by a section of the resistor element being guided through the at least one hole or is fixed to an auxiliary connection wire guided through the hole.

14. An air and/or aerosol heater in accordance with claim 1, wherein the fixing layer covers only a portion of the resistor element, wherein a remaining portion of the resistor element is exposed to an environment external to the heater.

15. An air and/or aerosol heater in accordance with claim 1, wherein the fixing layer extends continuously, without interruption, from one end of the tube to another end of the tube and the fixing layer extends three-hundred and sixty degrees about a longitudinal axis of the tube.

16. An air and/or aerosol heater in accordance with claim 1, wherein the fixing layer extends continuously, without interruption, from one end of the tube to another end of the tube and the fixing layer extends about only a portion of a circumference of the tube with respect to a longitudinal axis of the tube, wherein a portion of the resistor element is exposed to an environment external to the heater.

17. An air and/or aerosol heater in accordance with claim 1, wherein each portion of the fixing layer comprises a same material, the fixing layer being in direct contact with the resistor element, wherein the tube comprises a tube hole, wherein at least a portion of the resistor element is arranged in the tube hole.

18. An air and/or aerosol heater in accordance with claim 1, wherein the fixing layer comprises a first end portion and a second end portion, the first end portion engaging a first end portion of the tube and the second end portion engaging a second end portion of the tube, wherein a portion of the tube is not covered by the fixing layer, the portion of the tube being located between the first end portion and the second end portion.

19. An air and/or aerosol heater for an e-cigarette, the heater comprising:

a tube in which air and/or aerosol can be heated; and a resistor element arranged on an outer surface of the tube or on an inner surface of the tube, wherein the resistor element is fixed on the tube, the resistor element being fixed on the tube with a covering in at least some sections, with a fixing layer or with a casting, in at least some sections, with a fixing layer, at least a portion of the fixing layer defining at least a portion of an outermost layer of the heater, the tube comprising a tube wall with at least one hole in the tube wall, the resistor element being fixed by a section of the resistor element being guided through the at least one hole or is fixed to an auxiliary connection wire guided through the hole.

20. An air and/or aerosol heater for an e-cigarette, the heater comprising:

a tube in which air and/or aerosol can be heated; and a resistor element arranged on an outer surface of the tube or on an inner surface of the tube, wherein the resistor element is fixed on the tube, the resistor element being fixed on the tube with a covering in at least some sections, with a fixing layer or with a casting, in at least some sections, with a fixing layer, at least a portion of the fixing layer defining at least a portion of an outermost layer of the heater, the fixing layer covering only a portion of the resistor element, wherein a remaining portion of the resistor element is exposed to an environment external to the heater.

* * * * *